US006488175B2

(12) United States Patent
Shiffler et al.

(10) Patent No.: US 6,488,175 B2
(45) Date of Patent: Dec. 3, 2002

(54) DUSTING MITT DISPENSING SYSTEM

(75) Inventors: Benjamin N. Shiffler, County of Racine, WI (US); Marianne D. Davison, County of Kent, MI (US)

(73) Assignee: S.C. Johnson & Son, Inc., Racine, WI (US)

( * ) Notice: Subject to any disclaimer, the term of this patent is extended or adjusted under 35 U.S.C. 154(b) by 33 days.

(21) Appl. No.: 09/803,582

(22) Filed: Mar. 9, 2001

(65) Prior Publication Data

US 2002/0125264 A1 Sep. 12, 2002

(51) Int. Cl.[7] ..... A47K 10/24

(52) U.S. Cl. ..... 221/47; 229/87.16; 221/33; 221/63

(58) Field of Search ..... 221/33, 47, 63, 221/51, 53; 229/87.16

(56) References Cited

U.S. PATENT DOCUMENTS

| | | | | | |
|---|---|---|---|---|---|
| 2,137,398 | A | * | 11/1938 | Helber | 221/302 |
| 2,621,788 | A | | 12/1952 | Hitchcock | |
| 2,656,916 | A | * | 10/1953 | Henderson | 221/50 |
| 2,689,643 | A | * | 9/1954 | Willits | 206/445 |
| 3,195,772 | A | * | 7/1965 | Buttery | 221/33 |
| 3,486,657 | A | * | 12/1969 | Blatz | 206/299 |
| 3,819,043 | A | * | 6/1974 | Harrison | 206/205 |
| 4,714,643 | A | * | 12/1987 | Kuenzel | 206/233 |
| 4,997,105 | A | * | 3/1991 | Fischer | 206/278 |
| 5,096,089 | A | * | 3/1992 | McLaughlin | 221/197 |
| 5,542,566 | A | | 8/1996 | Glaug et al. | 221/48 |
| 5,921,434 | A | * | 7/1999 | Hollander et al. | 221/34 |
| 5,927,543 | A | | 7/1999 | Dejardin et al. | 221/56 |

* cited by examiner

*Primary Examiner*—Christopher P. Ellis
*Assistant Examiner*—Richard Ridley

(57) ABSTRACT

A dusting mitt dispensing device includes a container and a plurality of dusting mitts housed in the container. The container includes a bottom, a top, a front-side, a back-side and two lateral sides in which the top is integrally connected to the back-side along a top/back-side seam, and has cover flaps to cover the front-side and both lateral sides. The top is free to pivot about the top/back-side seam between a closed position and an open position, and contains a perforation pattern that forms an access flap and dispensing opening when the perforations are torn and the flap is opened. The access flap is integrally connected to the front side cover flap along a top/front-side flap seam, and is free to pivot about the top/front-side flap seam between a closed position and an open position in a direction opposite to the pivot direction of the top. Each of the plurality of dusting mitts is folded individually along its longitudinal axis and arranged to present the thumb of the dusting mitt as a removal tab. The dusting mitts are individually removable from the container by grasping the thumb of the top dusting mitt and pulling the thumb in a direction perpendicular to the longitudinal axis of the dusting mitt.

17 Claims, 5 Drawing Sheets

DUSTING MITT DISPENSING SYSTEM

CROSS-REFERENCE TO RELATED APPLICATIONS

Not applicable

STATEMENT REGARDING FEDERALLY SPONSORED RESEARCH/DEVELOPMENT

Not applicable

BACKGROUND OF THE INVENTION

1. Field of the Invention

This invention relates to a system for dispensing mitts having a thumbed mitt design from a disposable container. More particularly, the invention is directed to a system for dispensing dusting mitts for use in general household dusting and cleaning applications.

2. Description of the Related Art

Dispensing systems for paper products and thermoplastic gloves have long been available to the consumer to provide ready accessibility to articles that are generally one-time use items. Although the type of dispensing system for a given application is obviously dependent on the type of article involved, generally speaking, the design of such dispensing systems has involved balancing the desirability of easy release and ready accessibility of the articles contained within the dispenser, with such factors as unit cost, and the need to prevent the dispenser from releasing multiple items at one time. Other important design issues include dispenser capacity, and whether to cover or seal the unused articles during non-use.

U.S. Pat. No. 5,927,543 discloses a dispenser for gloves made of sheet material wherein a finger of the glove protrudes through a slot. Gloves are removed from the dispenser by grasping the protruding finger and pulling the glove in a direction parallel to the longitudinal axis of the glove. A securing device prevents multiple gloves from being removed at one time.

U.S. Pat. No. 5,542,566 discloses a reusable dispenser for disposable child mitt wipes, which has a hinged lid. The mitt wipes can be removed through an open lid of the dispenser or through a recloseable access opening on the top of the dispenser.

U.S. Pat. No. 4,997,105 discloses a glove dispensing system, in which gloves are placed on a plate in a rectangular container having a shield and a flap. A spring can be included to bias the plate/gloves toward a dispensing aperture.

U.S. Pat. No. 2,621,788 discloses a pocket tissue package, in which a paperboard rectangular carton has a removable window section through which individual folded sheets of tissue are removed. The tissues are folded so as to present folded corners to be grasped by the fingers.

While the foregoing patents describe dispensers for gloves, tissues or mitt wipes, none of these patents teaches or suggests a system for dispensing dusting mitts having a thumbed mitt design as in our invention. Removing an article from a dispenser by grasping the body or edge of the article as in the prior art is more cumbersome than grasping and pulling an easily accessible thumb tab as in our invention, and is more likely to result in the wasteful removal of multiple articles simultaneously. Accordingly, a need has arisen for a simple and economical system for dispensing mitts, such as dusting mitts, having a thumbed mitt design.

SUMMARY OF THE INVENTION

Our invention addresses the foregoing needs in the art by providing a dispensing system for dispensing dusting mitts having a thumbed mitt design from a disposable container.

In one aspect, a dispensing device of our invention includes a container and a plurality of dusting mitts housed in the container. The container includes a bottom, a top, a front-side, a back-side and two lateral sides, in which the top is integrally connected to the back-side along a top/back-side seam, and has cover flaps to cover the front-side and both lateral sides. The top is free to pivot about the axis of the top/back-side seam between a closed position and an open position, and contains a perforation pattern that forms an access flap and dispensing opening when the perforations are fully torn or otherwise severed. The access flap is integrally connected to the front-side cover flap along a top/front-side flap seam, and is free to pivot about the axis of the top/front-side flap seam between a closed position and an open position in a direction opposite to the pivot direction of the top. Alternatively, the access flap may be integrally connected to the back side along the top/back side seam, or to a lateral side along a top/lateral side flap seam, provided that the access flap is so dimensioned as to provide ready access to the thumb portion of the dusting mitts within the container, when the access flap is in an opened position. When the access flap is connected to a lateral side along a top/lateral side flap seam, the access flap is free to pivot about the axis of the top/lateral side flap seam in a direction transversed to the pivot direction of the top.

Each of the plurality of dusting mitts is folded individually along its longitudinal axis, stacked inside the container and arranged to present the thumb of the dusting mitt as a removal tab. The dusting mitts are individually removable from the container by grasping the thumb of the top dusting mitt and pulling the thumb in a direction perpendicular to the longitudinal axis of the dusting mitt.

Preferably, the dusting mitt dispensing system is manufactured from cardboard, paperboard and the like, and the dusting mitts housed in the container are preferably manufactured from woven or non-woven material. The dusting mitts themselves are the subject of a copending utility patent application Ser. No. 09/606,694 filed on Jun. 30, 2000, and three design patent applications, Ser. Nos. 29/125,759, 29/125,760 and 29/125,764, each also filed on Jun. 30, 2000. Each of these patent applications is incorporated herein by reference in its entirety.

BRIEF DESCRIPTION OF THE DRAWINGS

Like reference numerals have been used for like or corresponding elements throughout the views.

DESCRIPTION OF THE PREFERRED EMBODIMENTS

Figure 1:
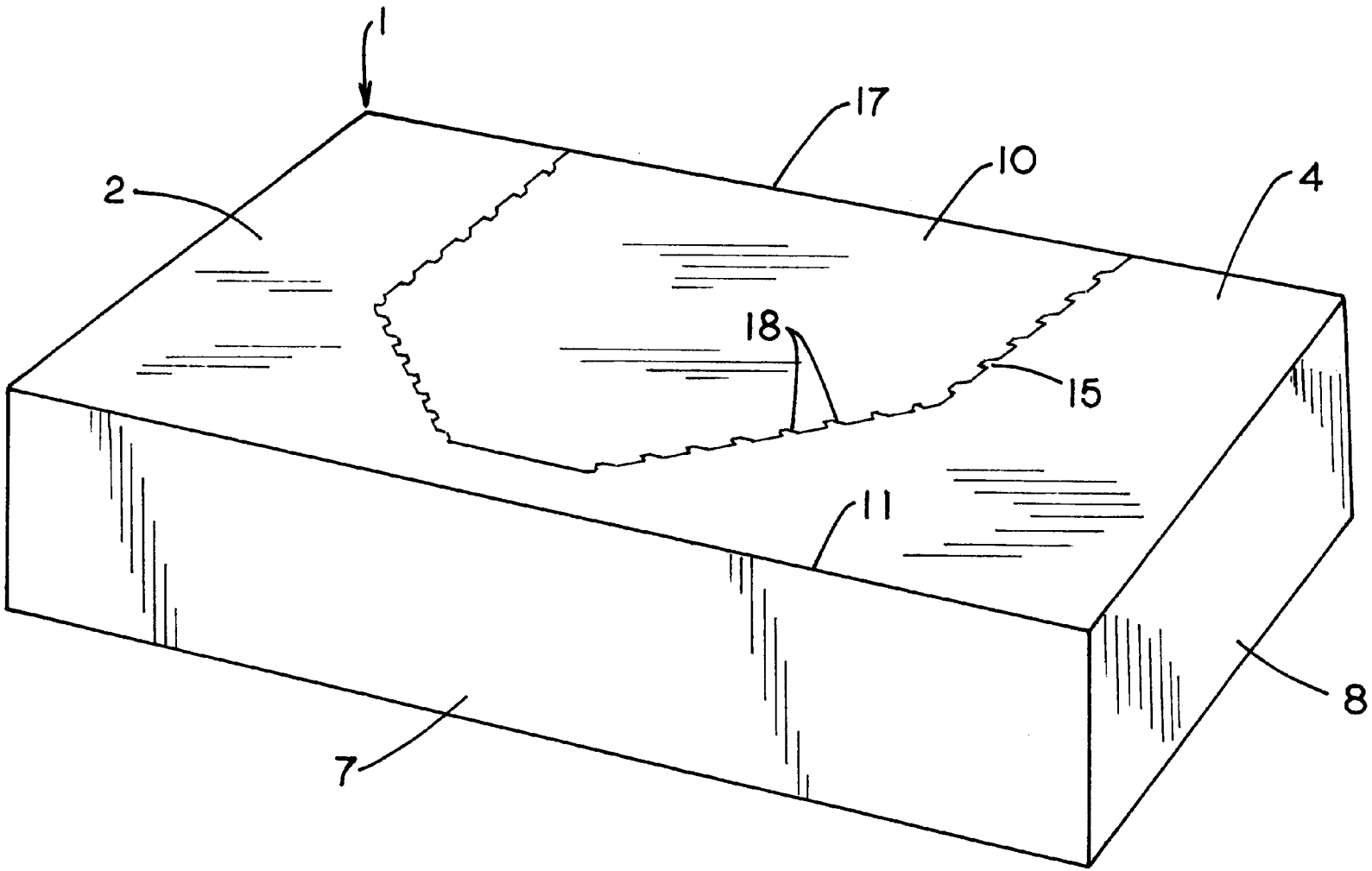
FIG. 1 is a perspective view of the dispensing container of our invention.

For illustrative purposes, the preferred embodiments of the dispensing system according to our invention are described in connection with the dispensing of dusting mitts having a thumbed mitt design.

Referring to FIGS. 1 to 5, a preferred embodiment of a system for dispensing dusting mitts having a thumbed mitt design is designated generally by reference numeral 1. The dispensing system 1 includes a container 2 and a plurality of dusting mitts 3 housed in the container 2. The container 2 is manufactured from cardboard, paperboard and the like, and has a top 4, a bottom 5, a front-side 6, a back-side 7, and two lateral sides 8, 9. The front-side 6 is attached to both lateral sides 8, 9 via, for example, integral male inserts (not shown) on the front-side 6 that respectively connect to corresponding female slits (not shown) on the lateral sides 8, 9. Similarly, the back-side 7 is attached to both lateral sides 8, 9 via integral male inserts (not shown) on the back-side 7, which respectively connect to corresponding female slits (not shown) on the lateral sides 8, 9.

Our invention provides flexibility to access the dusting mitts 3 either through opening an access flap 10 provided in the top 4, or by opening the top 4 of the container 2. In the former instance, the top 4 contains a perforation pattern 15 formed of perforations in the access flap 10 so that a dispensing opening 16 can be provided when the perforations are torn or otherwise severed and the access flap 10 is opened. In either case, the dusting mitts 3 can be protected during non-use by closing the access flap 10 and/or the top 4 of the container 2. The top 4 of the container 2 is integrally connected to the container back-side 7 along a top/back-side seam 11. The top 4 is free to pivot about the axis of the top/back-side seam 11 between a closed position (FIG. 1) and an open position (FIG. 4), and contains a front cover flap 12, and two lateral side cover flaps 13, 14 that cover the front-side 6 and two lateral sides 8, 9 respectively, when the top 4 is in the closed position. Gravity and the rigidity of the paperboard hold the top 4 in the closed position. The top 4 is held in an open position either by pivoting the top 4 far enough into the open position that gravity and the rigidity of the paperboard hold the top 4 in the open position, or by bending the lateral side cover flaps 13, 14 slightly so that they are supported by the top edge of the lateral sides 8, 9.

Figure 2:
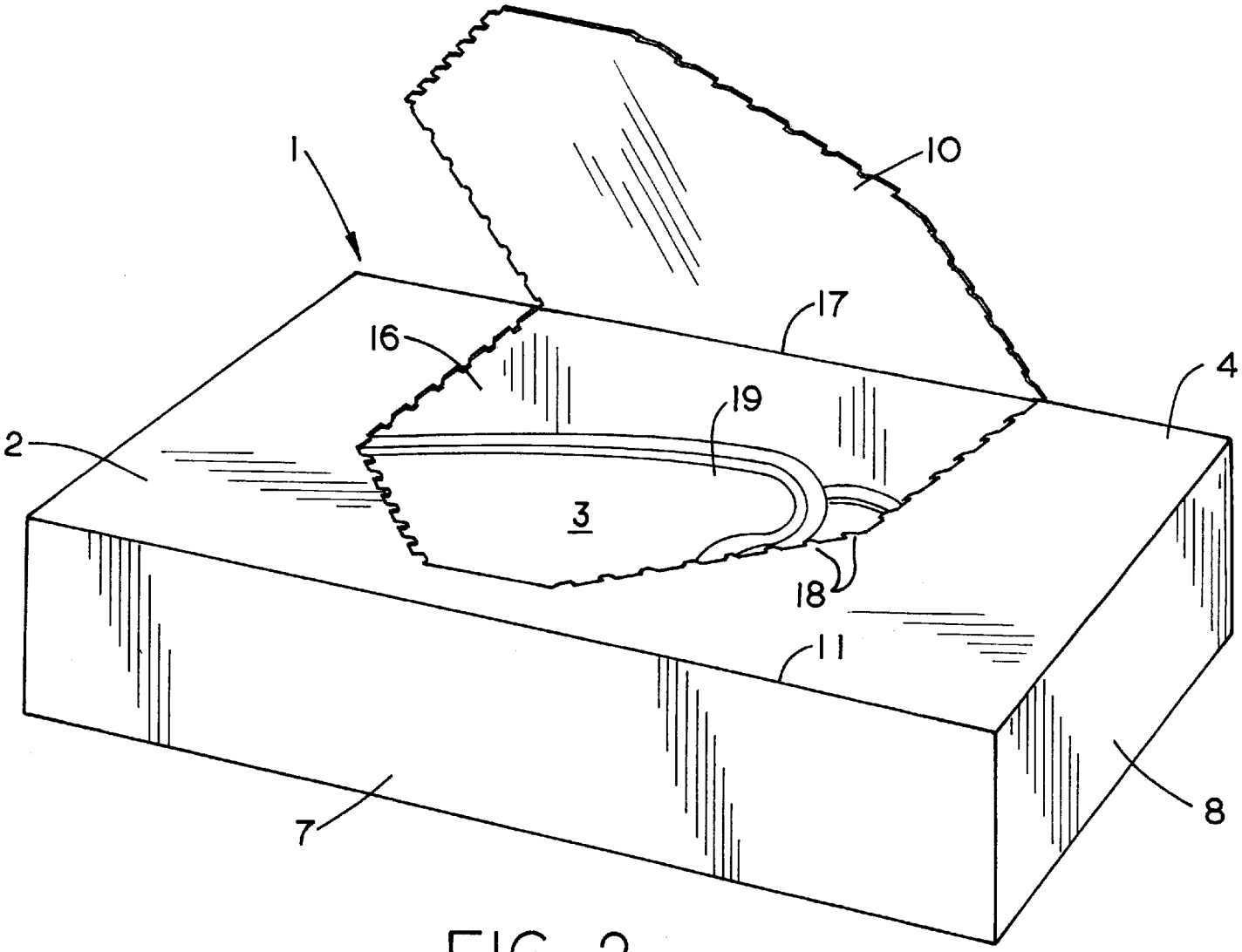
FIG. 2 is a perspective view of the dispensing container with its access flap in an open position.
Figure 3:
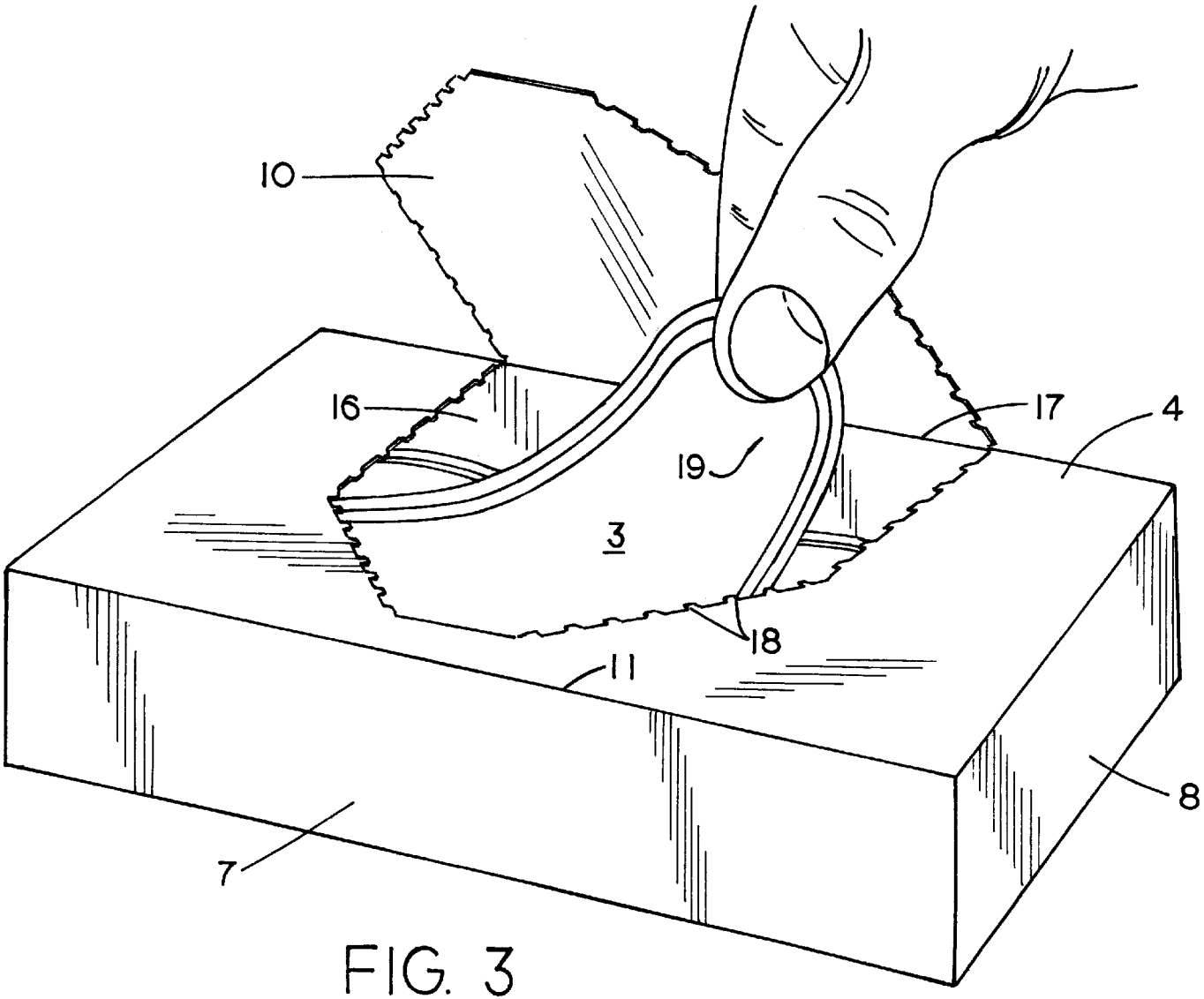
FIG. 3 is a perspective view showing the removal of a dusting mitt.
Figure 4:
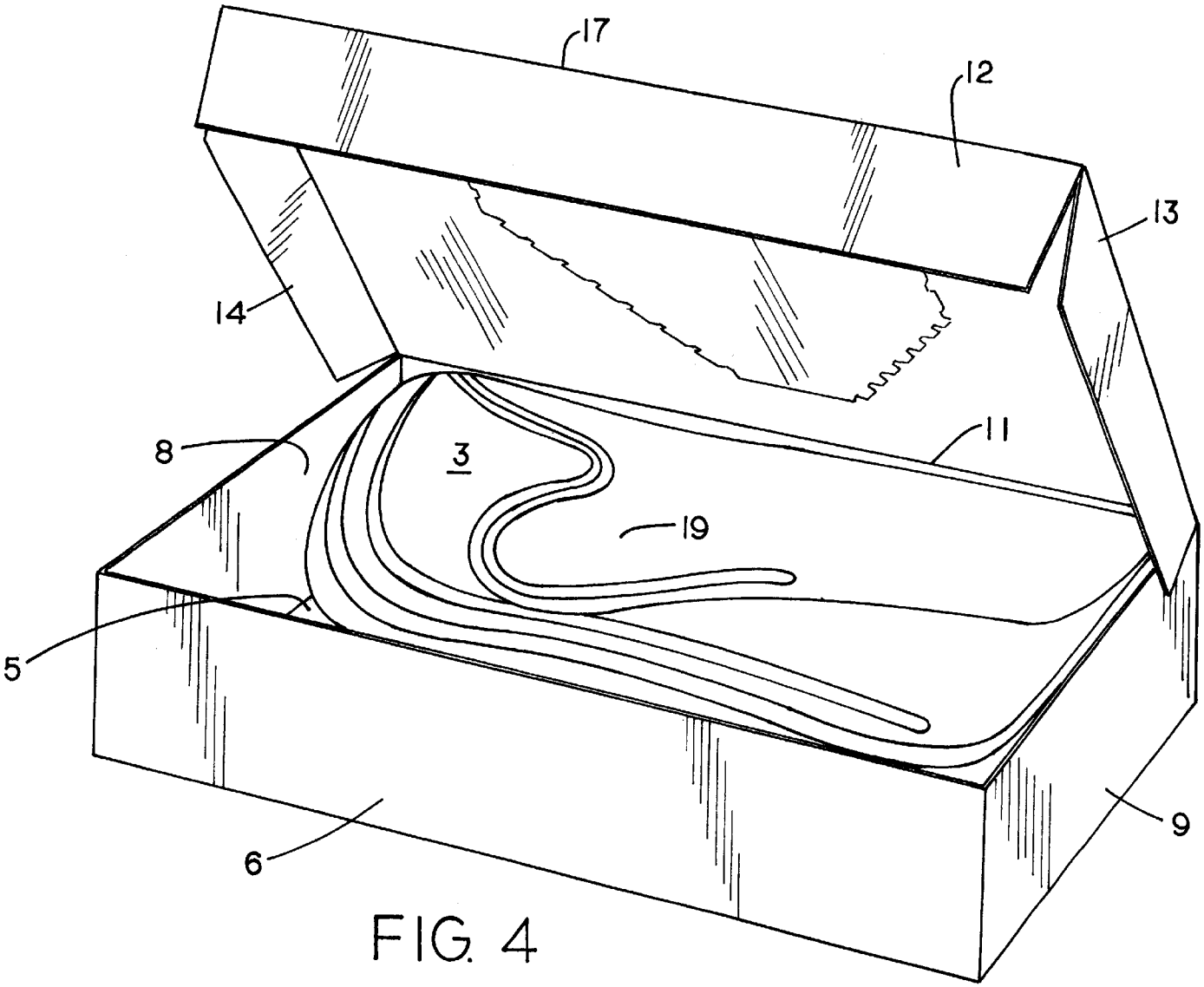
FIG. 4 is a perspective view showing stacked dusting mitts inside the dispensing container.

The access flap 10 is integrally connected to the front-side cover flap 12 along a top/front-side flap seam 17, and is free to pivot about the axis of the top/front-side flap seam 17 between a closed position (FIG. 1) and an open position (FIGS. 2 or 3). The access flap 10 is held in the open position by pivoting the access flap 10 far enough into the open position that gravity and the rigidity of the paperboard hold the open position. The access flap 10 is held in the closed position either by gravity and the rigidity of the paperboard, or by interconnecting a perforation slit 18 with the edge of the top 4 surrounding the dispensing opening 16.

Figure 5:
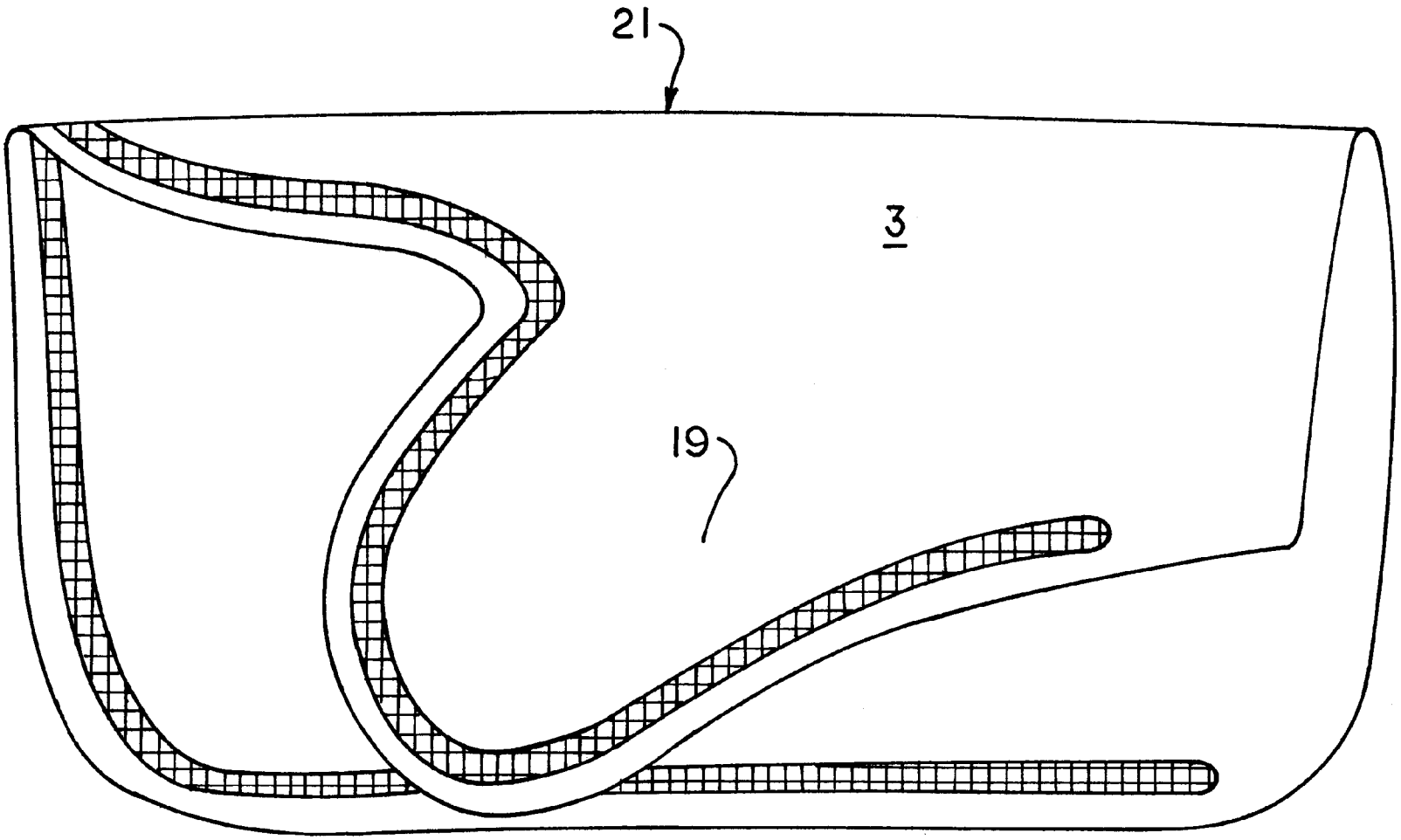
FIG. 5 illustrates a folded dusting mitt for use in our invention.

A plurality of dusting mitts 3 is folded along its longitudinal axis 21 (as shown in FIG. 5), stacked inside the container 2, and arranged inside the container 2 so as to present the thumb 19 of the dusting mitt 3 to the dispensing opening 16. With the top 4 of the container 2 in the closed position, a dusting mitt 3 is removed from the container 2 by opening the access flap 10, grasping the thumb 19 of the dusting mitt 3, and pulling the thumb 19 in a direction perpendicular to the longitudinal axis 21 of the dusting mitt 3 out through the dispensing opening 16. Similarly, with the top 4 of the container 2 in the open position, a dusting mitt 3 may be removed by grasping the thumb 19 of the dusting mitt 3 and pulling the thumb 19 in a direction perpendicular to the longitudinal axis 21 of the dusting mitt 3 directly out of the container 2.

The embodiments discussed above are representative of embodiments of the present invention and are provided for illustrative purposes only. They are not intended to limit the scope of the invention. Although components, materials, configurations, and means of connecting various parts have been shown and described, such are not limiting. Rather, modifications and variations are contemplated within the scope of the invention, which is intended to be limited only by the scope of the accompanying claims.

INDUSTRIAL APPLICABILITY

The dispensing system of our invention is suited for dispensing, for example, dusting mitts having a thumbed mitt design. Such mitts may be used in general household dusting and cleaning applications. Nevertheless, our invention also is suitable for dispensing other articles for other uses.

We claim:

1. A dispensing system for dispensing dusting mitts having a thumbed mitt design, the system comprising:

a container comprising a bottom, a top, a front-side, a back-side and two lateral sides, the top being integrally connected to the back-side along a top/back-side seam; and a plurality of dusting mitts stacked inside the container, each of the dusting mitts being folded individually along its longitudinal axis and arranged in the container so as to present the thumb of the dusting mitt as a removal tab.

2. The dispensing system according to claim 1, wherein the top is free to pivot about the axis of the top/back-side seam between a closed position and an open position.

3. The dispensing system according to claim 1, in which the top has a perforation pattern that forms an access flap and dispensing opening when perforations of the perforation pattern are torn and the access flap is opened.

4. The dispensing system according to claim 2, in which the top has a perforation pattern that forms an access flap and dispensing opening when perforations of the perforation pattern are torn and the access flap is opened.

5. The dispensing system according to claim 3, wherein the access flap is integrally connected to the front-side cover flap along a top/front-side flap seam and is free to pivot about the top/front-side flap seam between a closed position and an open position.

6. The dispensing system according to claim 4, wherein the access flap is integrally connected to the front-side cover flap along a top/front-side flap seam and is free to pivot about the top/front-side flap seam between a closed position and an open position in a direction opposite to the pivot direction of the top.

7. The dispensing system according to claim 2, in which the dusting mitts are individually removable from the container by grasping the thumb of the top dusting mitt and pulling the thumb in a direction perpendicular to the longitudinal axis of the dusting mitt out of the container through the open top.

8. The dispensing system according to claim 3, in which the dusting mitts are individually removable from the container by grasping the thumb of the top dusting mitt and pulling the thumb in a direction perpendicular to the longitudinal axis of the dusting mitt out of the container through the dispensing opening.

9. The dispensing system according to claim 4, in which the dusting mitts are individually removable from the container by grasping the thumb of the top dusting mitt and pulling the thumb in a direction perpendicular to the longitudinal axis of the dusting mitt out of the container through the dispensing opening.

10. The dispensing system according to claim 5, further including a perforation slit that may be interconnected with the edge of the top surrounding the dispensing opening to secure the flap to the top in the closed position.

11. The dispensing system according to claim 6, further including a perforation slit that may be interconnected with the edge of the top surrounding the dispensing opening to secure the flap to the top in the closed position.

12. The dispensing system according to claim 1, in which the dusting mitts are manufactured from woven or non-woven material.

13. A dispensing system for dispensing dusting mitts having a thumbed mitt design, the system comprising:

a container comprising a bottom, a top, a front-side, a back-side and two lateral sides, the top being integrally connected to the back-side along a top/back-side seam, wherein the top is free to pivot about the axis of the top/back-side seam between a closed position and an open position and has a perforation pattern that forms an access flap and dispensing opening when perforations of the perforation pattern are torn and the access flap is opened; and a plurality of dusting mitts stacked inside the container, each of the dusting mitts being folded individually along its longitudinal axis and arranged in the container so as to present the thumb of the dusting mitt as a removal tab.

14. The dispensing system according to claim 13, wherein the access flap is integrally connected to the front-side cover flap along a top/front-side flap seam and is free to pivot about the top/front-side flap seam between a closed position and an open position in a direction opposite to the pivot direction of the top.

15. The dispensing system according to claim 13, in which the dusting mitts are individually removable from the container by grasping the thumb of the top dusting mitt and pulling the thumb in a direction perpendicular to the longitudinal axis of the dusting mitt out of the container through the open top.

16. The dispensing system according to claim 13, further including a perforation slit that may be interconnected with the edge of the top surrounding the dispensing opening to secure the flap to the top in the closed position.

17. The dispensing system according to claim 13, in which the dusting mitts are manufactured from woven or non-woven material.

* * * * *